United States Patent [19]

Becera et al.

[11] Patent Number: 4,863,166

[45] Date of Patent: Sep. 5, 1989

[54] ADJUSTABLE THROWING TARGET

[76] Inventors: San J. Becera, 6304 S. Hulen; Vernon L. Stevenson, 6301 S. Hulen, both of Ft. Worth, Tex. 76133

[21] Appl. No.: 223,419

[22] Filed: Jul. 25, 1988

[51] Int. Cl.[4] ..... A63B 69/00

[52] U.S. Cl. ..... 273/26 A; 273/401

[58] Field of Search ..... 273/26 A, 398, 400, 273/401

[56] References Cited

U.S. PATENT DOCUMENTS

| | | | |
|---|---|---|---|
| 1,043,308 | 11/1912 | Everson | 273/26 A |
| 1,142,184 | 6/1915 | Lawrence | 273/26 A |
| 2,059,365 | 11/1936 | King | 273/26 A |
| 2,126,102 | 8/1938 | Fowler | 273/26 A |
| 2,895,737 | 7/1959 | Blees | 273/26 A |
| 3,312,467 | 4/1967 | Dawson | 273/26 A |
| 3,583,703 | 6/1971 | Brown et al. | 273/26 A |
| 3,711,092 | 1/1973 | Hogue | 273/26 A |
| 3,810,616 | 5/1974 | Murphy | 273/26 A |
| 3,929,334 | 12/1975 | Magazzu | 273/26 A |
| 3,997,158 | 12/1976 | Britton | 273/26 A |
| 4,083,559 | 4/1978 | Owen, Jr. | 273/26 A |
| 4,188,031 | 2/1980 | Fes | 273/26 A |
| 4,210,326 | 7/1980 | Booth et al. | 273/26 A |
| 4,254,952 | 3/1981 | Playter, Jr. | 273/26 A |
| 4,497,485 | 2/1985 | Macosko | 273/26 A |
| 4,783,070 | 11/1988 | Bauer et al. | 273/26 A |

*Primary Examiner*—William H. Grieb

*Attorney, Agent, or Firm*—Melvin A. Hunn

[57] ABSTRACT

A throwing target for arresting the flight of ball has a frame for defining a substantially vertical plane with a top rail spaced-apart from a bottom rail, first and second linkages coupled between the top rail and the bottom rail and traversely adjustable relative to each other and to the frame. A deformable band is releasably coupled to the first and second linkages at a plurality of positions for expanding and contracting to form a plurality of substantially rectangular target regions having a variety of selectable cross-sectional areas and positions relative to the frame depending in part upon the relative position of the first and second linkages and in part upon the location along the first and second linkages at which the deformable band is releasably coupled. A ball pouch is coupled to, and substantailly rearward of, the deformable band for arresting the flight of balls thrown through the deformable band, wherein balls thrown on-target are captured in the ball pouch and segregated from balls thrown off-target.

27 Claims, 2 Drawing Sheets

ADJUSTABLE THROWING TARGET

BACKGROUND OF THE INVENTION

1. Field of the Invention:

This invention relates generally to sports practice aids, and specifically to a throwing target for use with balls.

2. Description of the Prior Art:

In baseball, and other ball games, accuracy in throwing is a highly valued skilled, acquired only after considerable practice. For example, in the game of basebal throwing accuracy is required in both pitching and throwing-with, of course, pitching requiring greater accuracy than throwing.

In the game of baseball, the strike zone is not fixed in size and position. Rather the strike zone is defined, in-part, by the size and stance of the particular batter. The position of a batter can vary widely depending upon the batter's height, physique, and batting stance. Stances can range from an extreme crouch to a substantially upright position.

A successful pitching strategy requires a pattern of pitches, including some thrown within the strike zone and some thrown outside the strike zone, either too high, too low, too far out or too close in. In short, successful pitching requires great control and accuracy.

Throwing also requires considerable accuracy, but the throwing target, usually a baseman, is substantially larger than the pitching target. In addition, the baseman may adjust his or her position to catch balls thrown slightly off target. However, it is important that all balls be thrown within a range areas easily accessible by the baseman or catcher, requiring one only to shift body position or extend an arm to catch the ball. Throws that require a baseman or catcher to depart from his or her field position are undesirable.

A need exists for a combination throwing and pitching target that is sufficiently flexible in operation and easy to use. A variety of pitching throwing devices exist; however, none fully satisfy the training requirements of players insofar as they lack adjustability, and ease of operation.

SUMMARY OF THE INVENTION

The present invention is a throwing target for use with balls. A frame is provided for defining a substantially vertical plane. This frame has a top rail of selected length spaced apart from a bottom rail of selected length. First and second linkages, of selected lengths, are coupled between said top rail and said bottom rail. These linkages are traversely adjustable relative to each other and to said frame. A target means is releasably and adjustably fastened to the first and second linkages at a plurality of selectable locations. This target means is adjustable and cross-sectional area, width, and horizontal position relative to the frame in response to the relative placement of the first and second linkages within a frame. In addition, the target means is adjustable in cross-sectional area, height, and vertical position relative to said frame in response to the selectable locations at which the target means is fastened to first and second linkages. The target mean defines a target for arresting the flight of balls thrown on-target. The throwing target is simultaneously and successively adjustable in cross-sectional area, width, horizontal position, height, and vertical position.

In the preferred embodiment, the target means is defined by a deformable band releasably coupled to the first and second linkages at a plurality of vertical positions along said linkages for expanding and contracting to form a plurality of substantially rectangular planar target regions having a variety of selectable cross-sectional areas and positions relative to the frame. A ball pouch is coupled rearward of said deformable band for arresting the flight of balls thrown through the deformable band.

FIGS. *7a, 7b,* and *7c* are schematic drawings of the present invention depicting several possible adjustments in target position and area.

DESCRIPTION OF THE PREFERRED EMBODIMENT

Figure 1:
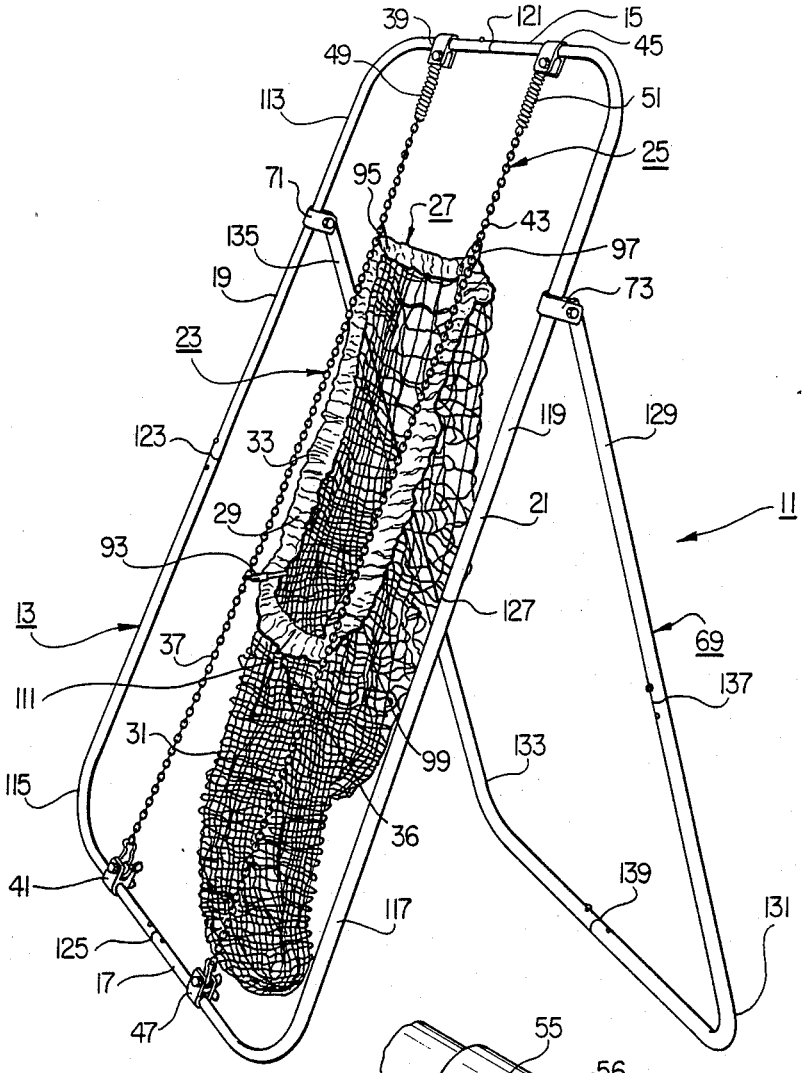
FIG. 1 is a perspective view of the throwing target of the present invention.

FIG. 1 is a perspective view of one preferred embodiment of the throwing target 11 of the present invention. For purposes of this specification, the term "throwing target" comprehends targets used for both throwing and pitching, Frame 13 of throwing target 11 defines a substantially vertical plane, and has a top rail 15 of selected length spaced apart from a bottom rail 17 of selected length.

In one preferred embodiment, the frame 13 comprises a rectangular frame with top rail 15 spaced apart from and substantially parallel to bottom rail 17. More specifically, frame 13 is formed from a plurality of tubular rails. Top rail 15 is carried above bottom rail 17 by first vertical tubular member 19 and second vertical tubular member 21.

First linkage 23 and second linkage 25 are coupled between top rail 15 and bottom rail 17. These linkages are traversely adjustable relative to each other and to frame 13 over a continuous range of positions. In one preferred embodiment, first and second linkages 23, 25 comprise a lengths of chain 37, 43 resiliently coupled between top rail 15 and bottom rail 17 at upper and lower anchor assemblies 39, 41, 45, 47.

More specifically, first chain 37 is connected to first upper anchor assembly 39 through first resilient coupling 49, which in one preferred embodiment comprises a spring. At bottom rail 17, first chain 37 is directly coupled to first lower anchor assembly 41. Second chain 43 is resiliently connected to second uper anchor assembly 45 through second resilient coupling 51, which in one preferred embodiment comprises a spring. At bottom rail 17, second chain 43 is directly coupled to second lower anchor assembly 47.

Figure 2:
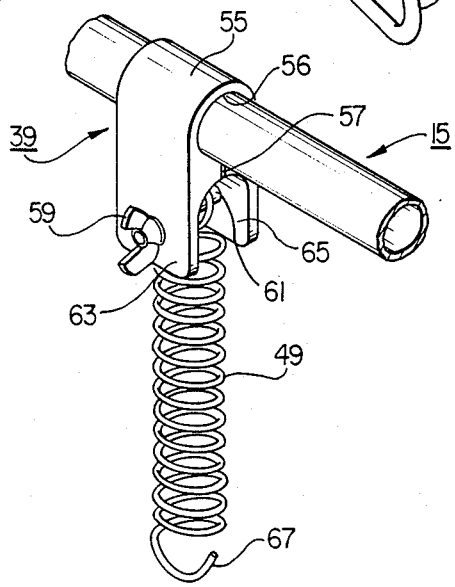
FIG. 2 is a fragmentary perspective view of the first upper anchor assembly of FIG. 1.

Turning now to FIG. 2, first upper anchor assembly 39 will be described in greater particularity. This anchor assembly is exemplary of the other anchor assemblies 41, 45 and 47. First upper anchor assembly 39 is slidably carried by top rail 15. It consists, in-part, of a sleeve 55 having a central bore 56 for receiving top rail 15. If viewed from the side, sleeve 55 forms an upside-down letter "U" with central bore 56 disposed at the bend of the u-shaped sleeve.

At it lower end, sleeve 55 terminates at oppositely facing legs 63, 65. A small gap 57 is provided between legs 63, 65 and communicates with central bore 56. This gap 57 allows legs 63, 65 to be compressed inward to slightly diminish the diamter of central bore 56. This feature allows sleeve 55 to be locked in place along top rail 15. A pair of aligned bolt apertures 62, 64 are provided in legs 63, 65 to accommodate a threaded bolt 61 which is secured in place by wing nut 59. Wing nut 59 may be tightened to pull legs 63, 65 together to clamp sleeve 55 in position along top rail 15. Upper anchor assembly may be repositioned along the length of top rail 15 by loosening wing nut 59 to unclamp sleeve 55 and sliding sleeve 55 to a new position along top rail 15.

In the preferred embodiment, first resilient coupling 49 is a spring which has hooks 67, 68 at each end (upper hook 68 is obscured in FIG. 2 by sleeve 55) for releasably couling to first chain 37 and threaded bolt 61.

Returning now to FIG. 1, frame 13 is held upright and rendered substantially free-standing by operation of brace 69, which is pivotally connected to said frame and extending rearward thereof. Brace 69 is adjustable to a plurality of angular positions relative to frame 13 for supporting it in a substantially upright free-standing position. In one preferred embodiment, brace 69 is pivotally coupled to frame 13 by adjustable brace couplings 71, 73 which connect brace 69 to first vertical tubular member 19 and second vertical tubular member 21 respectively.

Figure 3:
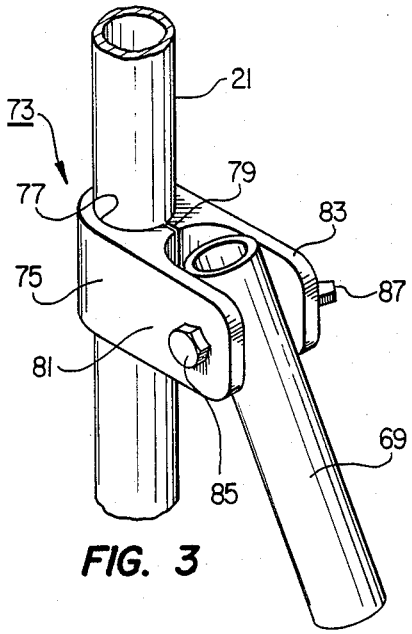
FIG. 3 is a fragmentary perspective view the adjustable brace coupling of FIG. 1.

Turning to FIG. 3, adjustable brace coupling 73 will be described in greater particularity. This addjustable coupling is very similar to adjustable brace coupling 71, and somewhat similar to the upper and lower anchor assemblies 39, 41, 45, and 47. Adjustable brace coupling 73 consists of sleeve 75 having a central bore 77 adapted to receive second vertical tubular member 21.

Like the anchor assemblies, sleeve 75 terminates at oppositely facing legs 81, 83 with a gap 79 also provided. The diameter of central bore 77 may be diminished by urging legs 81, 83 together, Legs 81, 83 are provided with bolt apertures 89, 91 (not shown) through which threaded bolt 85 is secured by wing nut 87. The upper end of brace 69 is provided with aligned apertures (not shown) for receiving threaded bolt 85.

Adjustable brace coupling 73 may be repositioned along the length of second vertical tubular member 21 by loosening wing nut 87 and sliding sleeve 75 upward and downward. In addition, the angular position of brace 69 relative to second vertical tubular member 21 may be adjusted by pivoting brace 69 inward or outward.

Returning now to FIG.1, target means 27 is releasably and adjustably fastened to first and second linkages 23, 25 at a plurality of selectable locations. Target means 27 is adjustable in cross-sectional area, width, and horizontal position relative to frame 13 in response to the relative placement of first and second linkages 23, 25 within frame 13. Moreover, target means 27 is adjustable in cross-sectional area, height, and vertical position relative to frame 13 in response to the selectable locations at which target means 27 is fastened to first and second linkages 23, 25.

Target means 27 is simultaneously and successively adjustable in cross-sectional area, width, horizontal position, height and vertical position. It is continuously adjustable in width and horizontal position relative to frame 13 over a range established by the selected length of top rail 15 and bottom rail 17. Moreover, target means 27 is continuously adjustable in height and vertical position relative to frame 13 over a range of established by the lengths of first and second linkages 23, 25.

In one preferred embodiment, target means 27 consists of a deformable band 29 releasably coupled to first and second linkages 23, 25 having a ball pouch 31 coupled to and substantially rearward of deformable band 29 for arresting the flight of balls thrown through the deformable band 29, wherein balls thrown on target are captured in ball pouch 31 and segregated from balls thrown off target.

Deformable band 29 comprises a deformable sleeve 33 constructed of durable cloth having a central passage adapted to receive drawstring 36. In one alternate embodiment, deformable band 29 may consist of an elastomeric element disposed in annular deformable sleeve 33. Deformable band 29 may be expanded or contracted to form a plurality of substantially rectangular target regions having a variety of selectable cross-sectional areas and positions relative to frame 13, depending in part upon the relative position of first and second linkages 23, 25 and in part upon the location along first and second linkages 23, 25 to which deformable band 29 is releasably coupled. In all embodiments, target means 27 is adjustable in cross-sectional area, height, vertical position, width, and lateral position, over a continuous range.

In one preferred embodiment, ball pouch 31 is substantially composed of limp, or "dead" netting. At a distance, ball pouch 31 does not visually distract or otherwise impede the pitcher, since it is rendered substantially transparent by use of netting material.

Deformable band 29 is adjustably coupled to first and second linkages 23, 25 by four adjustable target couplings 93, 95, 97, 99. More specifically, deformable band 29 is releasably coupled at two locations on first linkage 23, and at two locations on second linage 25. These locations define four corners of a substantially rectangular target formed by deformable band 29. Annular deformable band 29 may be repositioned vertically within frame 13, expanded, and contracted according to the relative vertical coupling of annular deformable band 29 to first and second linkages 23, 25.

Figure 4:
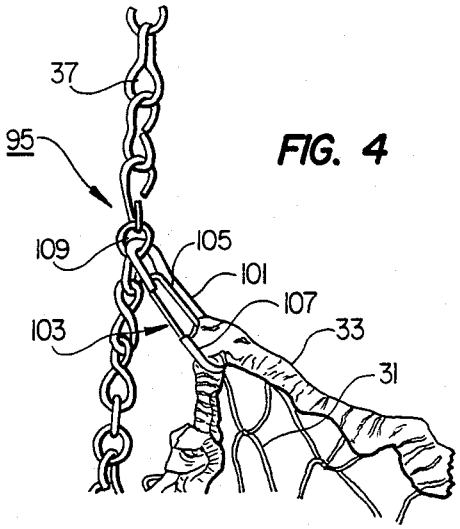
FIG. 4 is fragmentary perspective view of the adjustable target coupling of FIG. 1.

FIG. 4 is a perspective view of adjustable target coupling 95 of FIG. 1. Adjustable target couplings 93, 97, 99 are identical to adjustable target coupling 95. Elongated clip 101 serves to fasten deformable sleeve 33 to first chain 37. Elongated clip 101 has a gap 103 across which spring-biased gate 105 closes. Gate 105 is adapted to pivot inward only.

In operation, a location is selected along first chain 37 to which one desires to secure deformable band 29. Next, hook end 107 of elongated clip 101 is passed through eyelet 109 of first chain 37. Then, deformable sleeve 33 is urged through gap 103, causing gate 105 to pivot inward.

Figure 5:
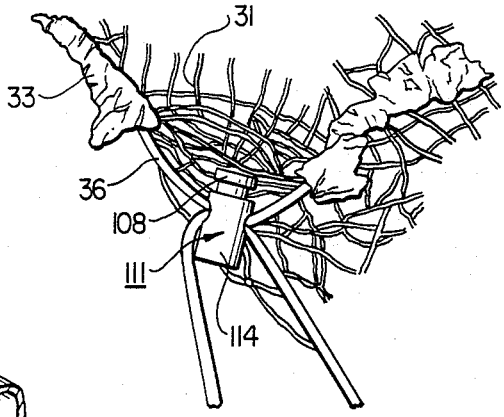
FIG. 5 is a fragmentary perspective view of the deformable sleeve, drawstring, and drawstring lock of FIG. 1.

FIG. 5 is a perspective view of the drawstring lock 111 of FIG. 1 through which drawstring 36 is threaded. Drawstring lock 111 is a cord lock of the type commonly employed in hiking and camping gear. It has a cap 108 concentrically and slidably disposed in sleeve 114; it is spring-biased upward. Sleeve 114 has a pair of eyelets 110, 112 (not shown) spaced 180 degrees apart from each other that are alignable with bore 116 (not shown) in cap 108. The two ends of drawstring 36 are threaded through all aligned eyelets 110, 112 and bore 116 when the cap 108 is depressed. Thereafter, cap 108 is depressed to expand or contract drawstring 36.

Drawstring 36 may be adjusted to expand or contract deformable band 29 in response to the relative placement of first and second linkages 23, 25 as well as the selected position along first and second linkages to which adjustable target couplings 93, 95, 97 and 99 are secured. Deformable sleeve 33 is adapted to gather or unfurl when the deformable band 29 is contracted or expanded respectively.

Throwing target 11 of the present invention is severable into a plurality of interlocking pieces, allowing throwing target 11 to be disassembled for transport. In the preferred embodiment, both frame 13 and brace 69 are composed of a plurality of interlocking tubular members. More specifically, frame 13 is composed of four interlocking right angle pieces: upper-left frame piece 113, lower-left frame piece 115, lower-right frame piece 117, and upper-right frame piece 119.

Upper-left frame piece 113 and upper-right frame piece 119 releasably couple together at frame coupling 121 substantially disposed at the midsection of to top rail 15. Upper-left frame piece 113 and lower-left frame piece 115 releasably couple together at frame coupling 123, which is substantially disposed at the midsection of the first vertical tubular member 19. Lower-left frame piece 115 and lower-right frame piece 117 releasably coupled together at frame coupling 125, which is substantially disposed at the midregion of bottom rail 17. Upper-right frame piece 119 and lower-right frame piece 117 releasably couple together at frame coupling 127, which is substantially disposed at the midregion of second vertical tubular member 21.

Brace 69 is also composed of several interlocking brace pieces: upper-right brace piece 129, lower-right brace piece 131, lower-left brace piece 133, and upper-left brace piece 135. Upper-right brace piece is pivotally coupled to frame 13 at adjustable brace coupling 73, as discussed above. Also upper-left brace piece 135 is pivotally coupled to frame 13 at adjustable brace coupling 71. Upper-right brace piece 129 and lower-right brace piece 131 are releasably coupled together at brace coupling 137. Upper-left brace piece 135 and lower-left brace piece 133 are releasably coupled together at brace coupling 141 (obscured by ball pouch 31 in FIG. 1). Lower-right brace piece 131 and lower-left brace piece 133 are releasably coupled together at brace coupling 139.

Since frame 13, brace 69, target means 27, and first and second linkages 23, 25 are readily disassembled, the present throwing target 11 is rendered easily transportable.

Figure 6:
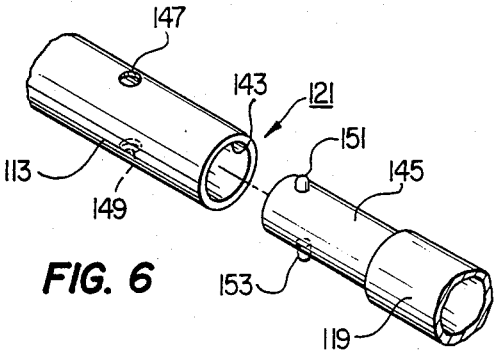
FIG. 6 is a framentary perspective exploded view of the frame coupling of FIG. 1.
Figure 7A:
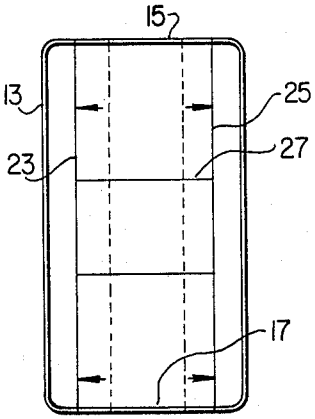
Figure 7B:
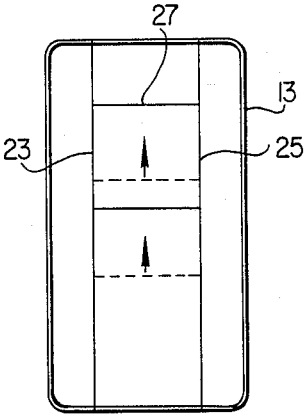
Figure 7C:
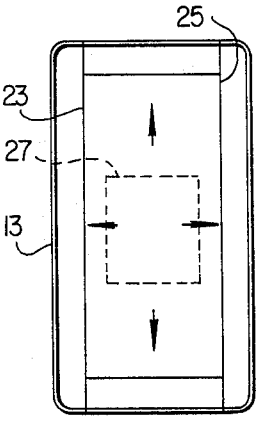

FIG. 6 is perspective, exploded cut-away view of frame coupling 121. This coupling is exemplary of the other frame and brace couplings. Upper-left frame piece 113 has a central bore 143 adapted to accommodate insert 145 of upper-right frame piece 119. A pair of spring-biased nipples 151, 153 are disposed 180° apart at the outer end of insert 145. A pair of lock ports 145, 149 are provided on upper-left frame piece 113, serving to receive spring-biased nipples 151, 153.

In operation, nipples 151, 153 are depressed, and insert 145 is urged inward along tubular bore 143 of upper-left frame piece 113. When spring-biased nipples 151, 153 encounter lock ports 145, 149, they spring outward, locking the upper left frame piece 113 to the upper right frame piece 119. When disassembly is desired, spring-biased nipples 151, 153 are simply pressed inward while the frame pieces are pulled apart.

FIGS *7a, 7b,* and *7c* depict throwing target 11 in schematic form, and will be used to describe the operation thereof. Target means 27 may be widened, narrowed or repositioned laterally within frame 13. FIG. *7a* depicts in graphic form the method of widening target means 27 wherein first linkage 23 is moved to the left, and second linkage 25 is moved to the right. As discussed above linkages 23, 25 may be moved relative to frame 13 by operation of first and second upper anchor assemblies 39, 45, and first and second lower anchor assemblies 41, 47. In conjunction with the relative placement of the anchor assemblies, drawstring lock 111 is depressed and deformable band 29 is allowed to expand.

Target means 27 may be narrowed by the reverse process, wherein first and second linkages 23, 25 are moved inward, and deformable band 29 is contracted. Target means 27 may also be repositioned laterally within frame 13 by simply moving first and second linkages 23, 25 in the same direction, without expanding or contracting deformable band 29.

FIG. *7b* depicts in schematic form the vertical repositioning of target means 27 within frame 13. The height of target means 27 may also be increased or decreased. For vertical movement, first and second linkages 23, 25 remain in their original position and adjustable target couplings 93, 95, 97 and 99 are unfastened from first and second linkages 23, 25, and refastened at desired locations along said first and second linkages 23, 25.

If an increase in height is desired, adjustable target couplings 95 and 97 are moved upward along first and second linkages 23, 25 respectively, and adjustable target couplings 93, 99 are moved downward along first and second linkages 23, 25 respectively. To decrease the vertical height of target means 27, adjustable target couplings 93, 99 are moved upward while adjustable target couplings 95, 97 are moved downward. If the height of target means 27 is either increased or decreased, the deformable band 29 must be expanded or contracted to accommodate the change.

As depicted in FIG. *7c,* target means 27 may also be expanded and contracted concentrically about a center point. To achieve an expansion, first and second linkages 23, 25 are moved in opposite directions, while adjustable target couplings 95, 97 are moved upward and adjustable target couplings 93, 99 are moved downward. To achieve a contraction of target means 27, first and second linkages 23, 25 are moved toward each other, while adjustable target couplings 95, 97 are moved down ward and adjustable target couplings, 93 99 are moved upward.

Of course, deformable band 29 must be expanded or contracted to conform with the overall expansion or contraction of target means 27. This is accomplished through use of drawstring 36. In the alternative, when an elastic band is disposed in deformable sleeve 33 instead of drawstring 36, such adjustment in the size of deformable band 29 occurs automatically, The present invention has a variety of advantages over prior art throwing targets.

First, the vertical position of the target zone is adjustable, allowing the zone to be raised, lowered, lengthened, or shortened.

Second, the lateral position of the target zone is adjustable, allowing it to be widened, narrowed, or moved laterally relative to the frame.

Third, the total surface area of the target zone as defined by the perimeter of the ball bag, may be expanded or contracted.

Fourth, the throwing target of the present invention identifies and distinguishes strikes from balls, thereby counting strikes and other successful throws.

Fifth, the present invention will disassemble into a plurality of easily transportable pieces, rendering the entire apparatus more easily transported.

Sixth, the brace of the present invention renders the throwing target free standing, while also allowing the frame to assume a plurality of substantially vertical positions.

Seventh, the resilient couplings of the first and second linkages serve to absorb the impact of balls thrown on target, lessening the destructive impact of balls upon the ball pouch, and simultaneously diminishing the physical displacement of the throwing target that results from the cumulative impact of repeated successful throws.

Eighth, the ball pouch of the present invention is releasably coupled to the first and second linkages, allowing for easy replacement in the event it becomes damaged through use.

Ninth, the deformable band that defines the outer perimeter of the target zone is adjustable to a large number of configurations and dimensions since it is incrementally adjustable over a continuous range of positions.

Tenth, multiple ball bags may be provided with the present invention to increase the ease of operation. After a number of balls have been thrown, the pitcher may unfasten the ball pouch from the first and second linkages, replace it with an empty ball pouch, and thereafter return to the pitching mound with the full ball pouch for another round of pitching.

Eleventh, the throwing target of the present invention serves a dual purpose as both a pitching target, and a throwing target.

Twelfth, the throwing target of the present invention eliminates all doubt as to whether a pitch or throw was on target. This eliminates the need for an umpire, and allows one to keep an accurate count of strikes.

Thirteenth, the throwing target of the present invention rewards accurate throws by segregating those balls from inaccurate throws. Balls that are thrown off-target must be gathered.

Fourteenth, the throwing target of the present invention serves as a excellent training tool in the game of baseball. Young, inexperienced ball players are often not very accurate in their pitching. The present invention allows them to practice pitching to over-sized strike zones to build confidence, and allows for the gradual, incremental downward adjustment in strike zone size as confidence and accuracy increase.

Fifteenth, the throwing target of the present invention is adjustable to accommodate a plurality of different sized players, rendering the present invention useful in both Little Leagues and Major Leagues.

While the invention has been particularly shown and described with reference to a preferred embodiment, it will be understood by those skilled in the art that various changes in form and detail may be made therein without departing from the scope of the invention.

I claim:

1. A throwing target for use with balls, comprising:
   a frame for defining a substantially vertical plane, having a top rail of selected length space apart from a bottom rail of selected length;
   first and second linkages, of selected lengths, coupled between said top rail and said bottom rail, traversely adjustable relative to each other and to said frame; and
   a target means, releasably and adjustably fastened to said first and second linkages at a plurality of selectable locations, adjustable in cross-sectional area, width, and horizontal position relative to said frame in response to the relative placement of said first and second linkages within said frame, and adjustable in cross-sectional area, height and vertical position relative to said frame in response to the selectable locations at which said target means is fastened to said first and second linkages, for defining a target and arresting the flight of balls thrown on-target.

2. A throwing target according to claim 1 wherein said target means is simultaneously adjustable in cross-sectional area, width, horizontal position, height, and vertical position.

3. A throwing target according to claim 1 wherein said target means is successively adjustable in cross-sectional area, width, horizontal position, height, and verticle position.

4. A throwing target according to claim 1 wherein said target means is both simultaneously and successively adjustable in cross-sectional area, width, horizontal position, height, and verticle position.

5. A throwing target according to claim 1 wherein said target means is a continuously adjustable in width and horizontal position relative to said frame over a range established by the selected lengths of said top and bottom rails.

6. A throwing target according to claim 1 wherein said target means is continuously adjustable in height and vertical position relative to said frame over a range established by the lengths of said first and second linkages.

7. A throwing target for arresting the flight of balls comprising:
   a frame for defining a substantially vertical plane, having a top rail spaced apart from a bottom rail;
   first and second linkages coupled between said top rail and said bottom rail traversely adjustable relative to each other and to said frame;
   a deformable band releasable coupled to said first and second linkages at a plurality of positions for expanding and contracting to form a plurality of substantially rectangular target regions having a variety of selectable cross-sectional areas and positions relative to said frame depending in-part upon the relative position of said first and second linkages and in-part upon the locations along said first and second linkages at which said deformable band is releasably coupled;
   a ball pouch coupled to, and substantially rearward of, said deformable band for arresting the flight of balls thrown through said deformable band, wherein balls thrown on-target are captured in said ball pouch and segregated from balls thrown off-target.

8. A throwing target according to claim 7 wherein said frame comprises a rectangular frame with said top rail spaced apart from and substantially parallel to said bottom rail.

9. A throwing target according to claim 7 wherein said ball pouch is substantially composed of limp netting.

10. A throwing target according to claim 7 further comprising:

a brace pivotally connected to said frame and extending rearward thereof, adjustable to a plurality of angular positions relative to said frame for supporting said frame in a substantially upright, free-standing position.

11. A throwing target according to claim 7 wherein said deformable band comprises an elastomeric element disposed in an annular deformable sleeve.

12. A throwing target according to claim 7 wherein said deformable band comprises a drawstring disposed in an annular deformable sleeve.

13. A throwing target according to claim 7 wherein said first and second linkages are traversely adjustable relative to each other and to said frame over a continuous range of positions.

14. A throwing target according to claim 7 wherein said deformable band is adjustable in cross-sectional area over a continuous range of areas.

15. A throwing target according to claim 7 wherein said deformable band may be coupled along substantially the entire length of said first and second linkages.

16. A throwing target according to claim 7 wherein said deformable band is releasable coupled at two locations on said first linkage and at two locations on said second linkage, for defining four corners of said substantially rectangular target formed by said annular deformable band.

17. A throwing target according to claim 7 wherein said first and second linkages are releasably coupled to said top and bottom rails, and wherein said frame is severable into a plurality of interlocking pieces, whereby said throwing target may be disassembled for transport.

18. A throwing target according to claim 7 wherein said first and second linkages each comprise a length of chain resiliently coupled between said top rail and said bottom rail.

19. A throwing target for arresting the flight of balls comprising:

a frame for defining a substantially vertical plane, having a length of horizontal top rail spaced apart from and substantially parallel to a length of horizontal bottom rail;

first and second upper anchor assemblies slidably carried by said length of horizontal top rail of said frame, traversely adjustable relative to each other along said length of horizontal top rail over a continuous range of positions;

first and second lower anchor assemblies slidably carried by said length of horizontal bottom rail of said frame, traversely adjustable relative to each other said length of horizontal bottom rail over a continuous range of positions;

a first linkage coupled between said first upper anchor assembly and said first lower anchor assembly, traversely adjustable within said substantially vertical plane defined by said frame over a continuous range of positions as said first upper anchor assembly and said first lower anchor assembly are positioned along said length of horizontal top rail and said length of horizontal bottom rail respectively;

a second linkage coupled between said second upper anchor assembly and said second lower anchor assembly, traversely adjustable within said substantially vertical plane defined by said frame over a continuous range of positions as said second upper anchor assembly and said second lower anchor assembly are positioned along said length of horizontal top rail and said length of horizontal bottom rail respectively;

an annular deformable band releasably coupled to said first and second linkages at a plurality of vertical positions along said first and second linkages for expanding and contracting to form a plurality of substantially rectangular planar target regions having a variety of selectable cross-sectional areas and postions relative to said frame;

a ball pouch coupled to and substantially rearward of said annular deformable band for arresting the flight of balls thrown through said annular deformable band; and wherein said annular deformable band may be repositioned laterally within said substantially vertical plane, expanded, and contracted according to the traverse position of said first and second upper anchor assemblies and said first and second lower anchor assemblies, and wherein said annular deformable band may be repositioned vertically within said substantially vertical plane, expanded, and contracted according to the relative vertical coupling of said annular deformable band to said first and second linkages.

20. A throwing target according to claim 19 wherein said frame comprises a substantially rectangular frame having a horizontal top tubular rail spaced apart from, and carried above, a horizontal bottom tubular rail by first and second vertical tubular members.

21. A throwing target according to claim 19 wherein said first and second upper anchor assemblies and said first and second lower anchor assemblies are concentrically carried by said length of horizontal top rail and said length of horizontal bottom rail respectively.

22. A throwing target according to claim 19 wherein said first and second upper anchor assemblies and said first and second lower anchor assemblies each comprise a sleeve concentrically carried by said horizontal top rail and said horizontal bottom rail respectively, each having a locking mechanism for securing said first and second upper anchor assemblies and said first and second lower anchor assemblies in a selected location along said horizontal top rail and said horizontal bottom rail of said frame.

23. A throwing target according to claim 19 wherein said annular deformable band is adjustable in cross-sectional area to form a plurality of substantially rectangular planar targets over a continuous range of areas.

24. A throwing target according to claim 19 wherein said annular deformable band comprises an elastomeric band disposed in an annular deformable sleeve.

25. A throwing target according to claim 19 further comprising means for resiliently coupling said first and second linkages to said frame.

26. A throwing target according to claim 19 further comprising:

a brace pivotally connected to said frame and extending rearward thereof, adjustable to a plurality of angular positions relative to said frame for supporting said frame in a substantially upright, free-standing position.

27. A throwing target according to claim 19 wherein said ball pouch comprises a limp net.

* * * * *